US008875545B2

(12) United States Patent
Caneva et al.

(10) Patent No.: US 8,875,545 B2
(45) Date of Patent: Nov. 4, 2014

(54) KNITTING HEAD FOR KNITTING MACHINES OF FLEXIBLE HOSES AND KNITTING MACHINE COMPRISING THE HEAD

(75) Inventors: Luigino Caneva, Altavilla Vicentina (IT); Gianmarco Caneva, Altavilla Vicentina (IT)

(73) Assignee: Luigino Caneva, Vicentina (VI) (IT)

( * ) Notice: Subject to any disclaimer, the term of this patent is extended or adjusted under 35 U.S.C. 154(b) by 0 days.

(21) Appl. No.: 13/979,297

(22) PCT Filed: Jan. 13, 2012

(86) PCT No.: PCT/IB2012/000042

§ 371 (c)(1),
(2), (4) Date: Jul. 11, 2013

(87) PCT Pub. No.: WO2012/095736

PCT Pub. Date: Jul. 19, 2012

(65) Prior Publication Data

US 2013/0283865 A1 Oct. 31, 2013

(30) Foreign Application Priority Data

Jan. 14, 2011 (IT) ..... VI2011A0002

(51) Int. Cl.
*D04B 9/44* (2006.01)
*D04B 15/68* (2006.01)

(52) U.S. Cl.
CPC . *D04B 9/44* (2013.01); *D04B 15/68* (2013.01)
USPC ..... 66/57

(58) Field of Classification Search
CPC ..... D04B 15/68; D04B 9/44; D04B 15/32; D04B 15/82
USPC ..... 66/8, 13, 17, 18, 57
See application file for complete search history.

(56) References Cited

U.S. PATENT DOCUMENTS

| | | | | |
|---|---|---|---|---|
| 2,032,993 | A * | 3/1936 | Larkin | 66/9 A |
| 2,201,905 | A | 5/1940 | Larkin | |
| 2,355,091 | A * | 8/1944 | McDonald | 68/21 |
| 3,871,194 | A * | 3/1975 | Greczin et al. | 66/9 A |
| 5,417,086 | A * | 5/1995 | Plath | 66/57 |

FOREIGN PATENT DOCUMENTS

WO WO 2010 052657 A2 5/2010

* cited by examiner

*Primary Examiner* — Danny Worrell
(74) *Attorney, Agent, or Firm* — R. Neil Sudol; Henry D. Coleman

(57) ABSTRACT

A knitting head of a knitting machine for manufacturing flexible hoses (1) with a knitted reinforcement layer, which comprises a guide body (14) with a central tubular conduit (15) for the passage of the bearing layer (2) and having a outlet end portion (16) with a first outer peripheral surface (17) having a first predetermined radius (r1), a plurality of knitting needles (18) arranged along the periphery of said end portion (16) of said conduit (15) and having first longitudinal end sections (18') arranged along the circumference of said outer peripheral surface (17) and second longitudinal end sections (18") arranged over a second cylindrical surface (19) having a second radius (r2) greater than said first radius (r1), at least one disk-shaped cam element (22), which is adapted to rotate at a first rotation speed and has a third predetermined radius (r3). The third radius (r3) is greater than said second radius (r2), connection means (23) being provided for connecting said disk-shaped element (22) to said second end sections (18") of said needles (18), said connection means (23) having at least one longitudinal portion (24) with a radial dimension decreasing from said third radius (r3) to said second radius (r2).

13 Claims, 5 Drawing Sheets

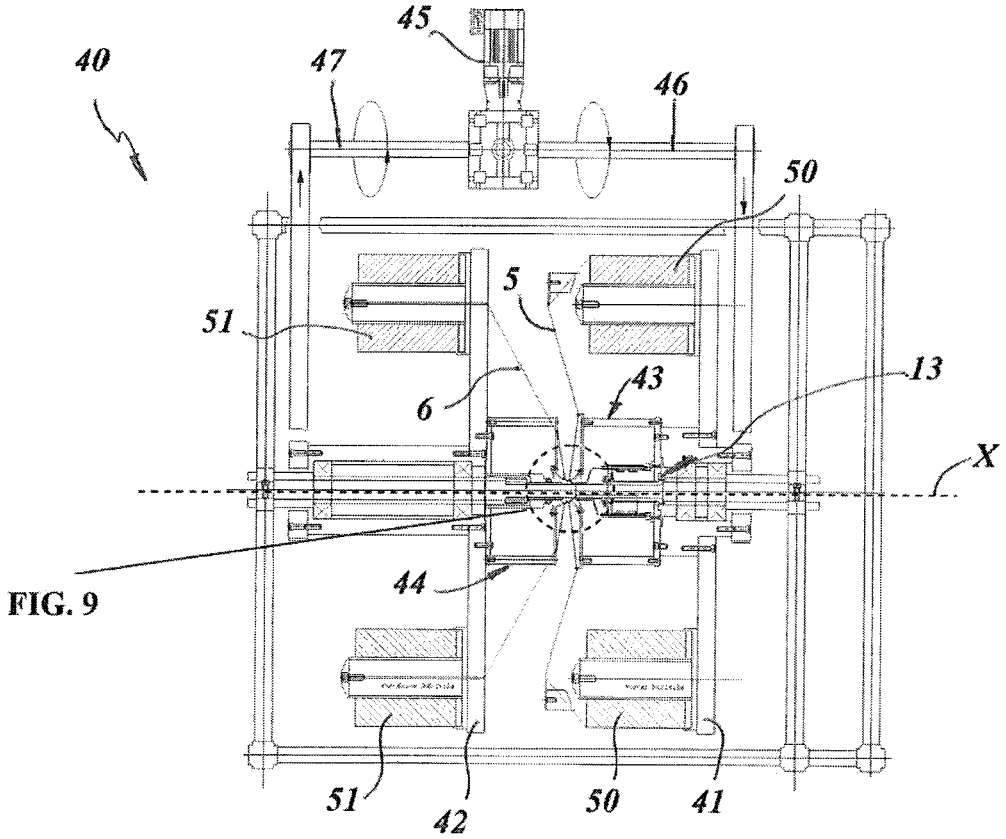
FIG. 9
FIG. 8
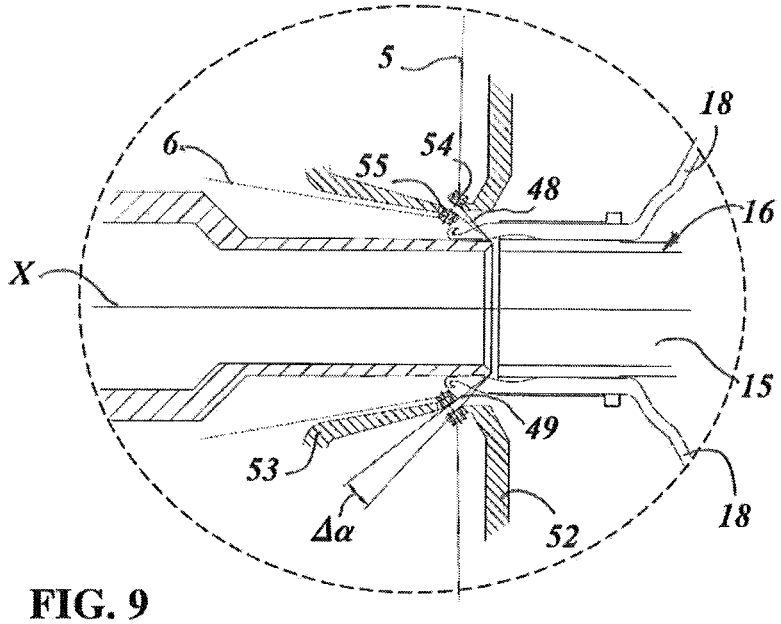
FIG. 9

KNITTING HEAD FOR KNITTING MACHINES OF FLEXIBLE HOSES AND KNITTING MACHINE COMPRISING THE HEAD

The present invention relates to a knitting head of a knitting machine which is adapted to be included in irrigation hose manufacturing plants, producing hoses having at least one tubular bearing layer made of plastic or rubber and at least one knitted reinforcement layer lying over the bearing layer, as well as a knitting machine comprising the knitting head.

Flexible irrigation hoses are known to be possibly composed of one or more tubular inner layers made of plastic or rubber and one or more tubular covering layers, also made of plastic or rubber, with at least one textile reinforcement layer therebetween. The reinforcement layer is configured according to the mechanical properties to be imparted to the hose, such as burst strength, flexibility or the ability to prevent kinking, i.e. flattening of hoses when they are twisted, with the creation of local throttles or obstructions therein.

The reinforcement layers are generally composed of synthetic or natural textile fibers, braided or knitted together to form tricot stitches. Particularly, the knitted reinforcement layer is selected where high kinking resistance is required, and is preferred in medium- to high-quality watering hoses.

Typically, the knitted layer is formed by a knitting machine having a knitting head, with the tubular bearing layer being fed therethrough to receive the knitted layer over it.

The head has a plurality of knitting needles, having one end fixed to a disk-shaped cam, whose rotation causes their oscillation in a longitudinal direction parallel to the direction of feed of the bearing layer.

The yarns that are designed to form the knitted layer are unwound from bobbins mounted to a rotatable holder and are directed to the needles by means of a yarn guide rotating with the holder. To ensure the required malleability, the reinforcement layer should have a proper stitch density.

In prior art hoses reinforced with longitudinal tricot stitches, the number of stitches is equal to the number of needles, and the latter is not limited, except by the space available along the knitting circumference.

Furthermore, in order to improve burst strength and malleability, double knitting reinforcement layers may be provided, which consist of two series of yarns braided together to form a single-layer knitted reinforcement with wales substantially parallel to the axis of the hose and courses with opposite inclinations with respect to it.

In such single-layer knitted arrangement, the two series of yarns are helically wound on the bearing layer with mutually opposite inclinations with respect to the axis of the hose, and the stitches are formed by both series of yarns; furthermore, since the knit is formed using two series of yarns rotating in opposite directions, the number of needles depends on the number of yarns and cannot be selected as desired.

In this case, the knitting machine should allow the use of a great number of yarns, the number of yarns depending on the number of needles and hence of stitches that can be formed on the hose reinforcement structure.

Each series of yarns is unwound from bobbins mounted to a corresponding holder and is directed to the needles by a corresponding yarn guide, the knitting process requiring the yarn guide, and hence the yarn, to be at a proper distance from the needle, as too short or too long a distance would prevent the needle from catching the yarn.

Nevertheless, one drawback of prior art knitting machines is the difficulty of forming double-knitted reinforcement layers having a relatively small diameter, like common watering hoses, and with the right number of stitches because, since the number of needles should be typically equal to the sum of the yarns of each series, cams should have a great number of crests, which would involve technical restrictions in this configuration.

The object of the present invention is to at least partially obviate the above drawback, by providing a knitting head for a knitting machine that can form knitted reinforcement layers, particularly of the type having two series of stitches, with a relatively small diameter and a greater number of wales than prior art hoses of the same diameter, to obtain irrigation hoses having a high pressure resistance and superior malleability.

These and other objects, as better explained hereafter, are fulfilled by a knitting head as defined in claim 1. The provision of connection means of decreasing radial dimensions allows the use of cams of greater diameters, i.e. with a greater number of crests, which will afford the use of a great number of needles, e.g. twice as many as in prior art solutions for knitting layers of the same diameter, which will increase stitch density and improve hose malleability.

Further characteristics and advantages of the invention will become more apparent upon reading of the detailed description of a few preferred, non-exclusive embodiments of a knitting head and a knitting machine of the invention, which are described as non-limiting examples with the help with the accompanying drawings in which:

FIG. 8 is a schematic sectional view of a knitting machine with two series of yarns;

FIG. 9 shows a detail of the machine of FIG. 8.

FIGS. 1 and 2 show two examples of a hose having a knitted reinforced layer formed by a head of the invention.

Figure 1:
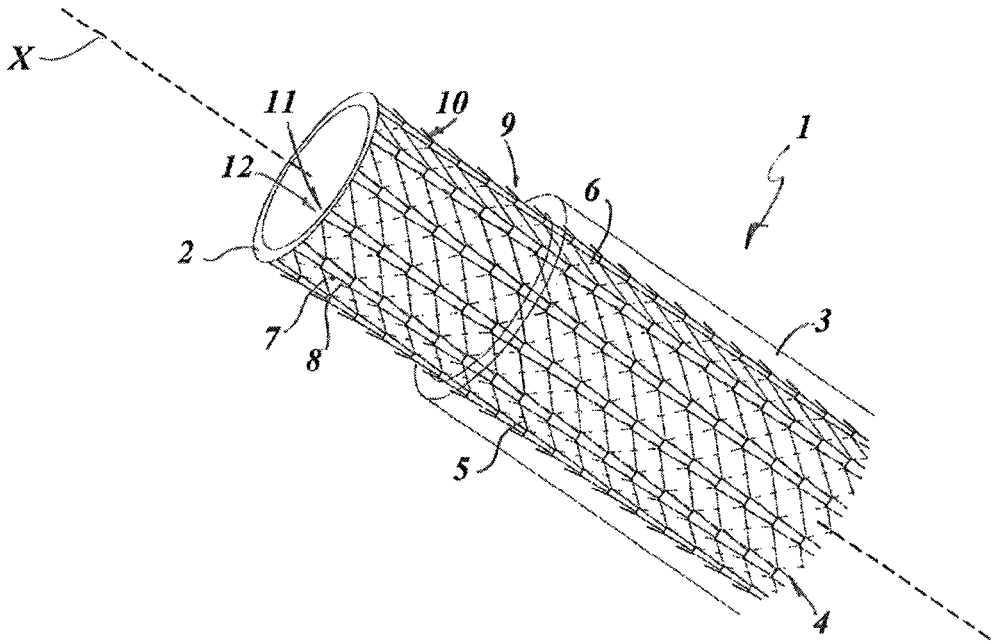
FIGS. 1 and 2 are perspective views of a hose having a reinforced layer formed by a knitting head of the invention.

The hose, generally designated by numeral 1, may comprise an inner tubular layer 2 defining a longitudinal axis X, an outer tubular layer 3 and a reinforcement layer 4 between the two inner 2 and outer 3 tubular layers. The inner layer 2 and the outer layer 3 are coaxial with each other and may be made of a plastic- or rubber-like polymeric material, such as PVC. As is known in the art, additional layers, not shown, may be also located internal to the inner layer 2 and/or external to the outer layer 3.

The reinforcement layer 5 is of the tricot knitted type and may be made of textile fibers, such as polyamide or polyester. Nevertheless, other types of synthetic or natural fibers may be also used.

The knitted reinforcement layer 4 is helically wound on the inner layer 3 and comprises first and second series of yarns, 5 and 6 respectively, which are helically wound on the inner layer 2, at substantially identical helical pitches, and knitted together to form a plurality of chain stitches 7, 8 arranged in courses 9, 10 having respective inclinations with respect to the longitudinal axis X and wales 11, 12.

Particularly the chain stitches 7, 8 may be substantially longitudinal and define wales 11, 12 substantially parallel to the axis X.

In the configuration of FIG. 1, the wales 11, 12 are in overlapped relation and each stitch 7, 9 is composed of a pair of substantially completely overlapped loops. Namely, each chain stitch 7, 8 is composed of a first stitch loop defined by a portion of a yarn of the first series 5 and a second stitch loop defined by a portion of a yarn of the second series 6.

Furthermore, each stitch 7, 8 is linked to a pair of adjacent stitches of the same wale. Therefore, the first loop and the second loop of each chain 7, 8 are both linked to the first and second loops of the two adjacent stitches.

The courses 9 of the first series of yarns 6 are inclined with respect to the longitudinal axis X with an inclination opposite to that of the courses 10 of the second series of yarns 6, with respective predetermined inclination angles, preferably having equal values and opposite signs.

Advantageously, regardless of their inclination angles, the courses 9 of the first series of yarns 5 only overlap the courses 10 of the second series of yarns 6 at their respective stitches 7, 8.

Figure 2:
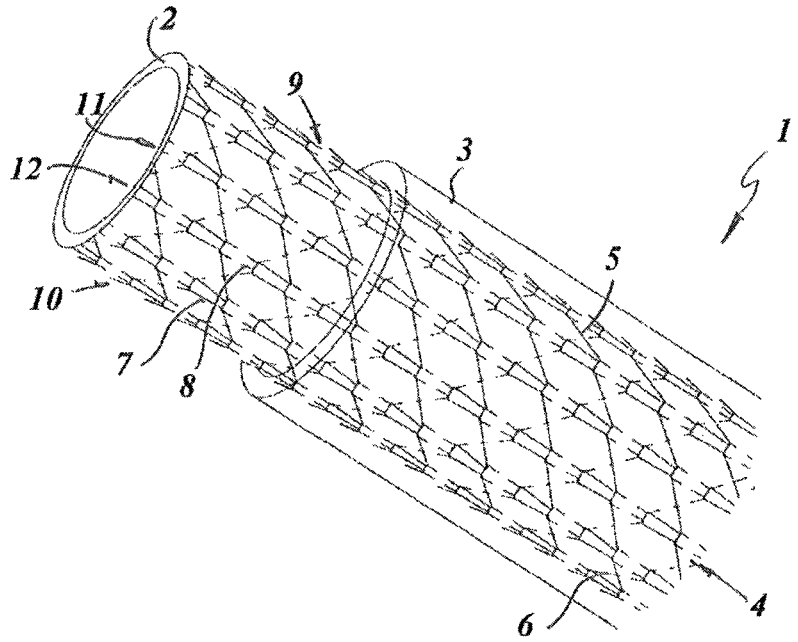

In FIG. 2, the reinforcement layer 4 is composed of longitudinal wales 11, 12, with longitudinal stitches 7, 8. However, the wales 11 of the first series 5 are offset from the wales 12 of the second series 6 and at equal angular distances.

Figure 3:
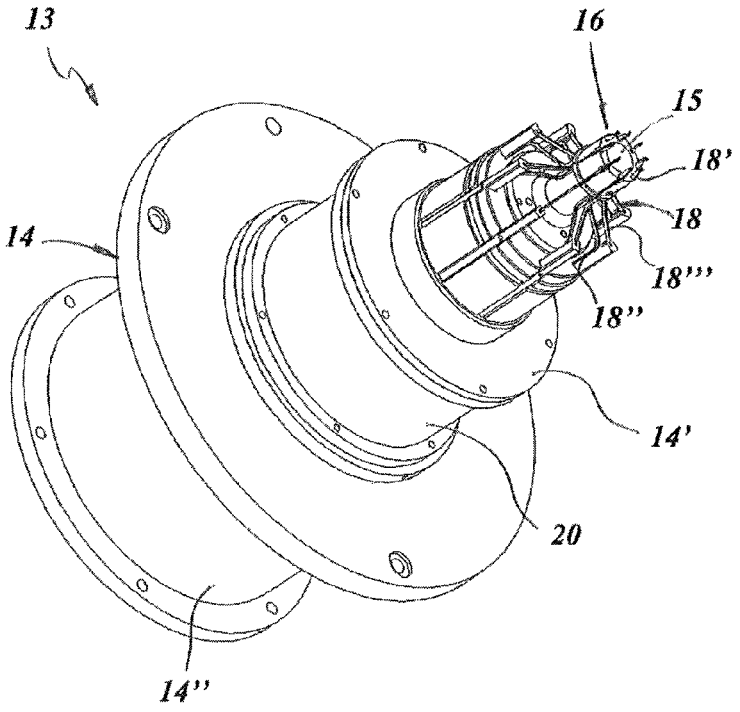
FIG. 3 is a perspective view of the head of the invention according to a first embodiment.

FIG. 3 shows a knitting head 13 of the invention, comprising a guide body 14 with a central tubular conduit 15 for the passage of the tubular bearing layer 2.

Figure 4:
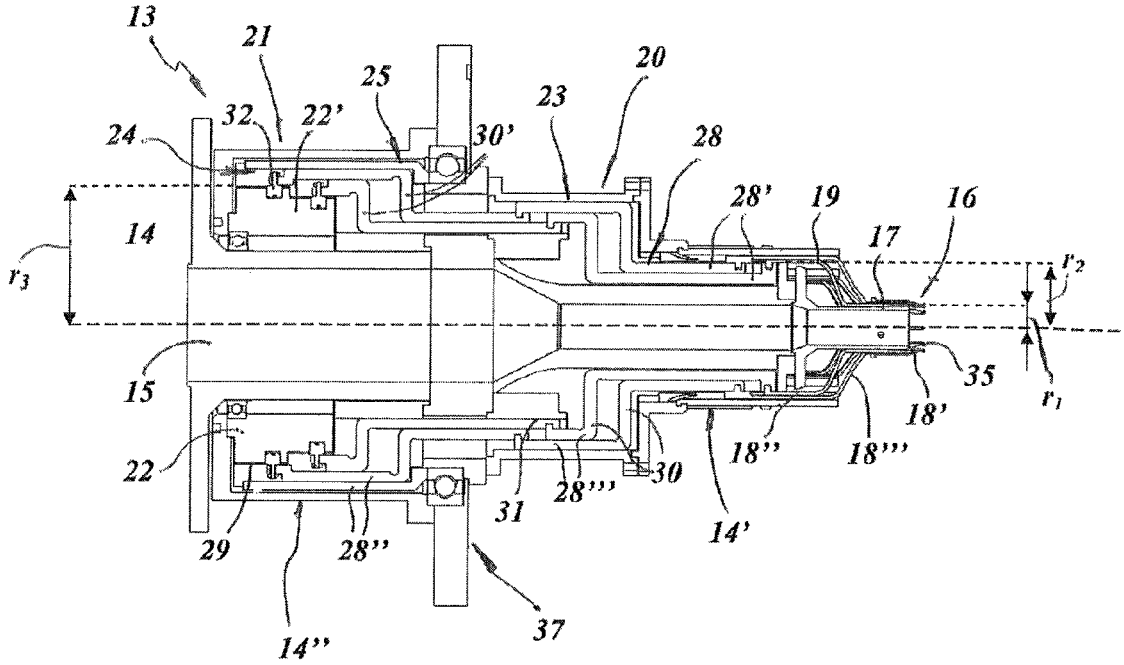
FIG. 4 is a sectional side view of the head of FIG. 3.
Figure 5:
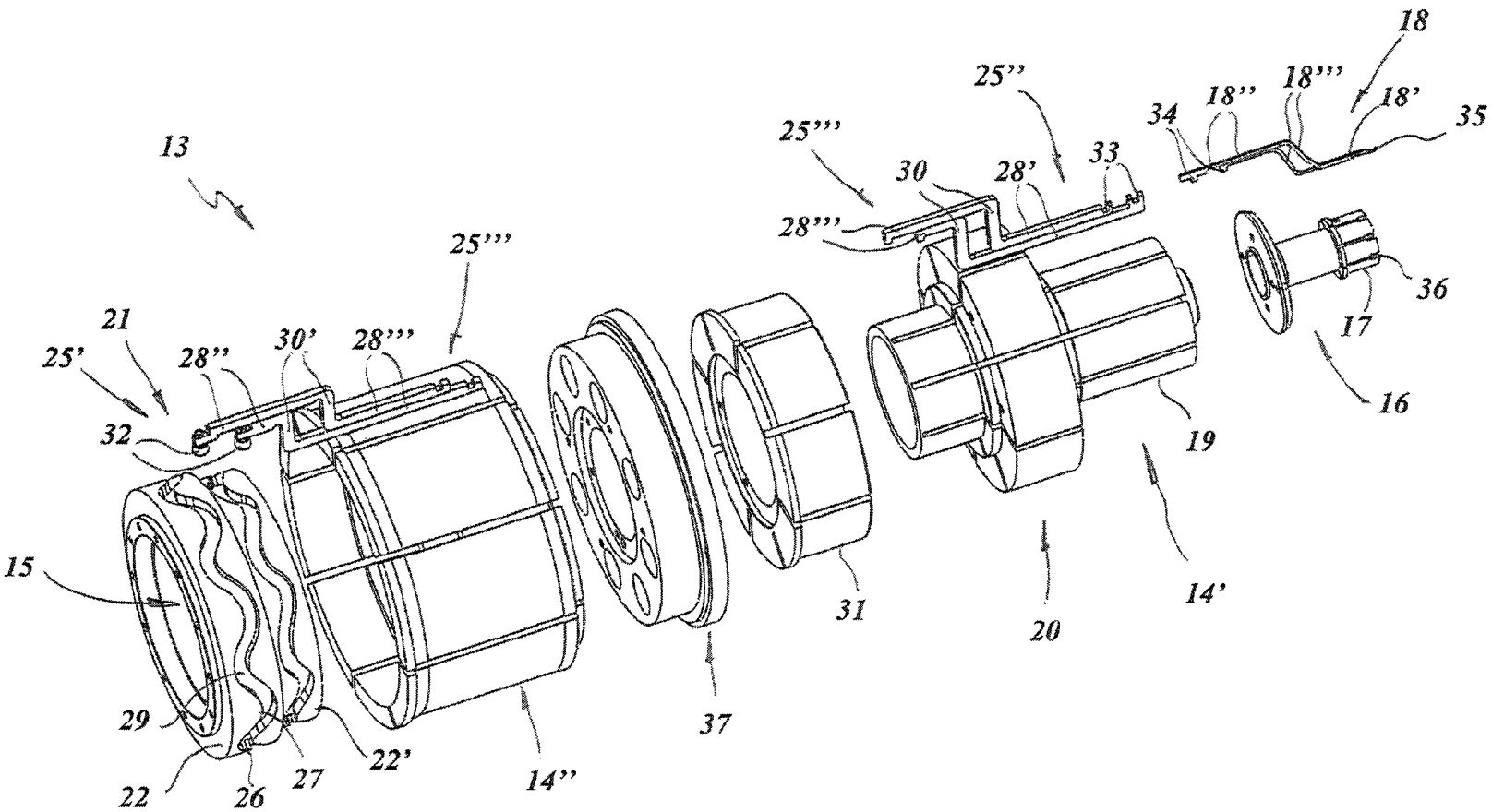
FIG. 5 is an exploded perspective view of the head of FIG. 3.
Figure 6:
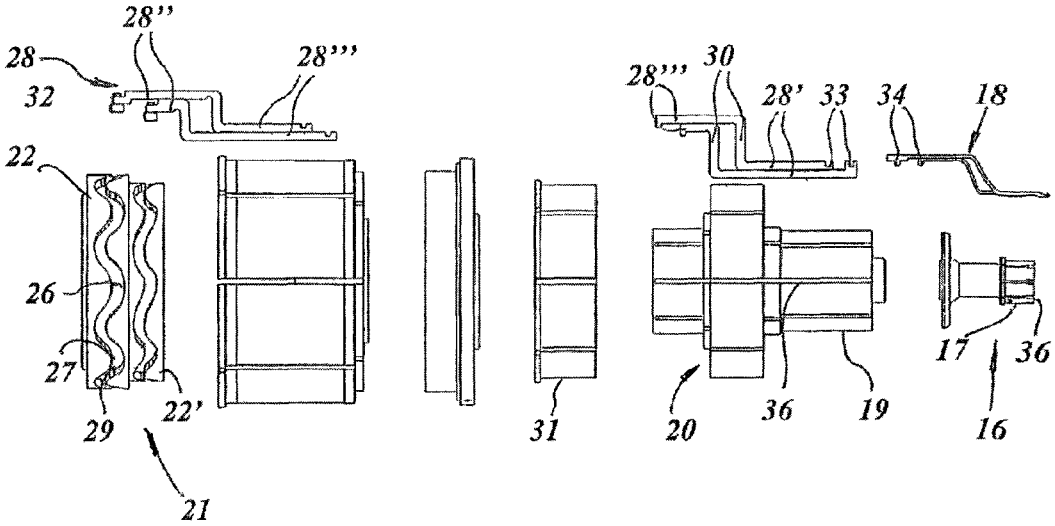
FIG. 6 is an exploded side view of the head of FIG. 3, with certain elements being omitted.

The conduit 15 defines a longitudinal axis that coincides with the extension axis X of the tubular layer 2 and has a delivery end portion 16 (FIGS. 4, 5 and 6) for delivery of the tubular layer 2, with a first outer peripheral surface 17 having a first predetermined radius r1.

At the end portion 16, a plurality of knitting needles 18 are peripherally arranged along the circumference of such end portion 16.

The needles 18 may be either compound needles, as shown in the figures, or latch needles. In any case, any prior art needle may be used.

The needles 18 generally have first longitudinal end sections 18' arranged along the circumference of the first outer peripheral surface 17 and second end longitudinal sections 18' arranged along a second cylindrical surface 19 having a second radius r2 greater than the first radius r1.

The second cylindrical surface 19 may be either the peripheral surface of a central portion 20 of the guide body 16 or a theoretical surface defined by the second end sections 18" of the needles 18. The two end sections 18', 18" of each needle 18 are joined together by a radial connecting section 18".

The head 13 comprises cam means 21 operably connected to the second longitudinal sections 18" of the needles 18 to promote longitudinal oscillation thereof, such that needles can move from a first yarn catching limit position to a second yarn release limit position once they have formed the stitch, as is typically known to occur in knitting heads.

The cam means 21 comprise at least one disk-shaped cam element 22 which is designed to rotate about the longitudinal axis X and has a third predetermined radius r3 greater than the second radius r2.

Furthermore, connection means 23 are provided for connecting the disk-shaped element 22 to the second end sections 18" of the needles 18. Such connection means 23 have at least one longitudinal portion 24 whose radial dimension decreases from the third radius r3 to the second radius r2.

Particularly, the longitudinal portion 24 of the connection means 23 comprises a tubular element 25 which is rigidly joined to the needles 18 and has a first end section 25' connected to the disk-shaped element 22 and a second end section 25" connected to the needles 18.

The disk-shaped cam element 22 has a corrugated annular groove 26 on its outer peripheral surface, defining a predetermined number of longitudinal crests 27. For example, there may be 12 crests. In this case, the third radius r3 is determined at the surface of the groove 26.

Generally, the disk-shaped element 22 is designed to rotate at a predetermined angular speed, such that the product of the number of crests 27 and the number of revolutions per cycle is a predetermined value.

Therefore, the tubular connection element 25 has its first end section 25' inserted in the groove 26, so that as the cam element 22 rotates, it will translate longitudinally in alternate directions and, as a result, the needles 18 will also have an oscillatory motion in respective parallel and longitudinal directions.

The tubular connection element 25 may have a diameter gradually decreasing from the first end section 25' to the second end section 25" or may have a central portion that joins the first and second end portions and whose maximum radial dimension is equal to the difference between the third and second radiuses.

In a first embodiment, not shown, the tubular connection element 25 may have a tubular body with a diameter decreasing from the first section to the second section, in a gradual and continuous or discrete fashion. For example, it may consist of a plurality of cylindrical, concentric bells, having respective constant radiuses, decreasing from the first section to the second section. The tubular connection element 25 will also have a rotation-preventing device, allowing it to only move along the axis of the hose.

However, in the configuration of the figures, the tubular element 25 is composed of a plurality of substantially longitudinal rods 28 peripherally arranged along the circumference of the central conduit 15.

Each rod 28 has a first longitudinal end section 28' connected to a respective second end section 18" of a corresponding needle 18.

Furthermore, each rod 28 also has a second longitudinal end section 28" connected to the disk-shaped cam element 22. The second end sections 28" are also arranged over a third tubular peripheral surface 29, which is coaxial with the second surface 19 and has a radial dimension equal to or slightly larger than the third radius r3.

The first 28' and second 28" longitudinal sections of a rod 28 are joined by at least one respective radial section 30 whose radial length does not exceed the difference between the third r3 and second r2 radiuses.

In a preferred configuration, each rod 28 has at least one additional intermediate longitudinal section 28", on a fourth tubular surface 31 interposed between the second surface 19 and the third surface 29 and coaxial therewith. Each intermediate longitudinal section 28'" is joined to respective first and second longitudinal end sections 28', 28" by pairs of radial sections 30, 30'.

The second end section 28" of each rod 28 has one end inserted in the groove 26 of the disk-shaped cam element 22, e.g. by means of a dowel 32. The first end section 28' of each rod 28 has a seat 33 for receiving a tooth-shaped formation 34 of the needle 18, for the needles 18 to become integral with their rods 28 during translation.

The connection of the various longitudinal sections 28', 28", 28'" of a rod 28 is obtained by forming male and female connectors at adjacent ends of each longitudinal section.

Furthermore, if compound needles are used, each being formed by two longitudinal tongues sliding relative to each other, the system of longitudinal rods 28 will be provided in duplicate. In practice, each rod 28 will be formed of pairs of first longitudinal sections 28' and second longitudinal sections 28", joined by respective radial sections 30, 30' and possibly by intermediate longitudinal sections 28'".

The second end sections 28" of the second set of rods 28 will be connected to a second disk-shaped cam element 22' coaxial with the first element 22 whose diameter is shown herein to be slightly smaller than that of the first element 22, but may be also substantially identical or greater.

The second disk-shaped element 22' is designed to promote oscillation of the tongue to cause the hook-shaped head 35 of the needle 18 to open and close. Of course, as is known in the art, the two separate oscillation movements are appropriately phase-shifted and synchronized to allow needle heads 35 to appropriately catch and release the yarns 5, 6.

The rods 28 may slide in guide channels 36 on the outer peripheral surface of the guide body 14. The latter may be composed of multiple longitudinal and coaxial tubular portions with diameters decreasing from the cam means 21 to the needles 18, conforming to the path of the rods 28.

Furthermore, the guide body 14 may comprise a front portion 14' at the needles 18 and a rear portion 14" at the cam means 21. The two front 14' and rear 14" portions are separated by hermetic sealing means 37, such that any action on the head 13, e.g. replacement of the needles 18 or other components, may be made from the front portion 14' and not on the rear portion 14" which typically contains lubricant.

Generally, the disk-shaped element 22 is designed to rotate at the same angular speed as the yarn bobbin holder and must have a cam with as many crests 27 as there are yarns to be knitted.

Figure 7:
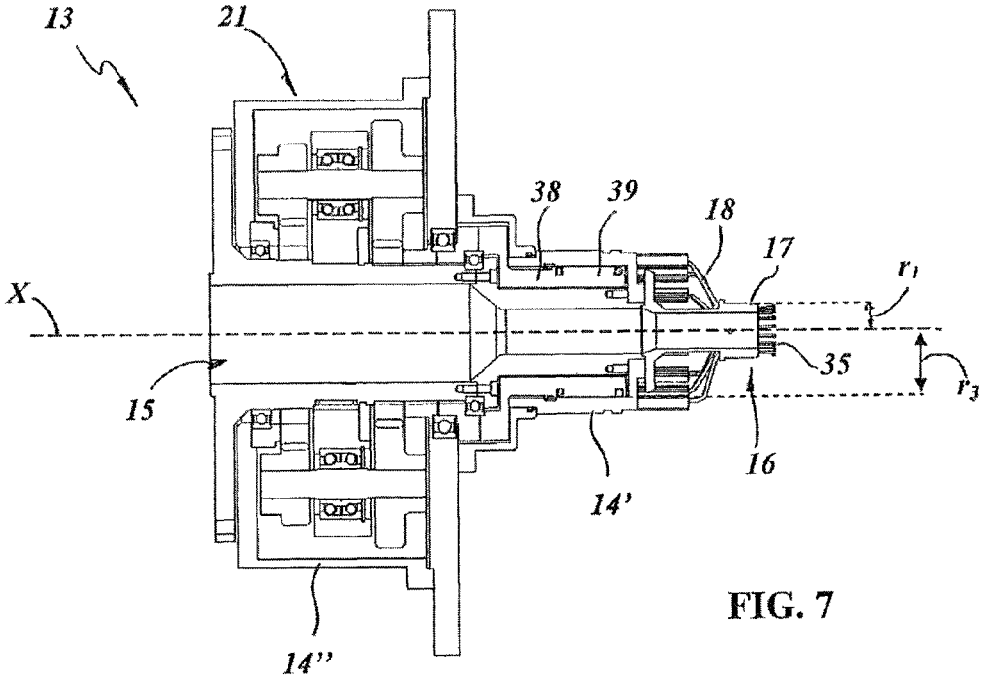
FIG. 7 is a sectional side view of the head according to a second embodiment.

In a further configuration, as shown in FIG. 7, there may be provided two cam elements 38, 39 defining a pair of grooves having respective crest profiles, which elements are coaxial and fixed to each other to rotate about the longitudinal axis X in the same direction and at the same rotation speed. The two disk-shaped elements 38, 39 have the same number of crests 27 and are operably connected to respective series of needles 18 to promote respective oscillations thereof with a predetermined phase shift.

This configuration can be used in a knitting machine, as described in greater detail hereinafter, which has bobbin holders, so that the disk-shaped elements 38, 39 rotate at the same first predetermined speed.

Such first rotation speed may be lower than, equal to or higher than the speed of the bobbin holders. Particularly, using a convenient transmission system, e.g. appropriately coupled gears, the first speed may be set to twice the speed of the bobbin holders. In this case, there will be such a number of crests that the product of the number of crests and the number of revolutions to be made by the cam upon a revolution of the bobbin holder is equal to the number of crests of the disk-shaped can element, whose rotation is synchronous with that of the bobbin holding disk.

FIG. 8 shows the knitting machine 40 for flexible hoses comprising an embodiment of the above described knitting head 13.

The machine 40 comprises a pair of bobbin holders 41, 42, rotating about the longitudinal axis X and designed to hold respective pluralities of yarn bobbins 5, 6 to form the reinforcement layer 4.

The bobbin holders 41, 42 are coaxial with each other and associated with corresponding yarn guides 43, 43, 44, which are designed to rotate integrally with their respective bobbin holders 41, 42 to deflect a length of yarn 5, 6 from each bobbin to a corresponding needle 18.

The supports 41, 42 are also adapted to rotate about the longitudinal axis X at respective equal and opposite second rotation speeds using a single motor 45 connected thereto by respective drives 46, 47, e.g. drive belts or the like.

FIG. 9 shows a detail of the configuration of the knitting head and the position of the yarn guides 43, 44, where the yarn guides 43, 44 are shown to have, as is known, respective cylindrical collars 52, 53, each having a plurality of holes 54, 55 on their peripheral surface, through which the yarns 5, 6 are deflected towards the needles 18. The diameter of these holes preferably ranges from 1 mm to 3 mm and more preferably is 1.5 mm. The axial distance of the delivery holes 54, 55 from the delivery edge of the conduit 15 ranges from 8 mm to 20 mm and preferably from 10 mm to 14 mm. The collars 52, 53 have a greater diameter than the delivery diameter of the tubular conduit 15, i.e. ranging from 10 mm to 30 mm, preferably from 15 mm to 20 mm.

Typically, each of the yarn guides 43, 44 is designed to place the deflected lengths of the yarns 5, 6 on respective frustoconical surfaces 48, 49, whose axes coincide with the longitudinal axis X and whose larger base is at the delivery sections where yarns 5, 6 are delivered from their yarn guides 43, 44, as shown in FIG. 9.

Furthermore, to avoid any interference between the yarns 5 that come from one of the holders 41 and the yarns 6 that come from the other holder 42, the frustoconical surfaces 48, 49 so defined have different aperture angles. Particularly, this difference ranges from 2° to 30° preferably from 7° to 15°.

This combination of features allows a great number of needles to be used even for small-diameter hoses, e.g. ½ inch hoses for irrigation use, thereby maintaining a high stitch density.

If the machine 40 has a head 13 with a single cam element 22, the first rotation speed of the latter will be equal to that of the bobbin holders 41, 42; if the head has two cam elements 38, 39 of smaller radius, these will have a first rotation speed equal to a multiple of, preferably twice the second rotation speed of the holders 41, 42.

According to further embodiments of use, the first rotation speed may also be lower than or equal to the second speed or higher but not necessarily an integer multiple thereof. For example, the first speed may be equal to half the second speed or possibly higher than the second speed by half of its value, so that each movement of each needle may cause the latter to catch both a yarn 5 from the first series and a yarn 6 from the second series.

With the above described knitting machine, two series of yarns 5, 6, mounted to respective rotating holders 41, 42, will be laid on the inner layer 2. Each yarn 5, 6 of the respective series comes from a respective bobbin 50, 51, and the same number of bobbins may be provided for each holder 41, 42. Particularly, time after time, two successive needles 18 may process yarns 5, 6 from different series.

The above description clearly shows that the invention fulfills the intended objects.

The head and machine of the invention are susceptible to a number of changes or variants, within the inventive concept disclosed in the appended claims. All the details thereof may be replaced by other technically equivalent parts, and the materials may vary depending on different needs, without departure from the scope of the invention.

While the head and machine have been described with particular reference to the accompanying figures, the numerals referred to in the disclosure and claims are only used for the sake of a better intelligibility of the invention and shall not be intended to limit the claimed scope in any manner.

The invention claimed is:

1. Knitting head for knitting machine adapted for manufacturing flexible hoses having a knitted reinforcement layer overlapping a tubular bearing layer, comprising:

a guide body with a central tubular conduit for passage of the bearing layer, said conduit defining a longitudinal axis and having an outlet end portion with a first external peripheral surface with a predetermined first radius;

a plurality of knitting needles peripherally distributed around said end portion of said conduit and having first longitudinal end lengths circularly placed on said external peripheral surface and second longitudinal end lengths placed on a second cylindrical surface having a second radius greater than said first radius;

at least one discoidal cam element rotatable about said longitudinal axis with a first rotation speed and having a predetermined third radius, said cam disk-element being operatively connected with said second longitudinal lengths of said needles to promote their longitudinal oscillation;

wherein said third radius is greater than said second radius and fastening means are provided for fastening said discoidal cam element to said second end lengths of said needles, said fastening means having at least one longitudinal portion with a radial dimension decreasing from said third radius to said second radius.

2. Head according to claim 1, wherein said longitudinal portion of said fastening means comprises a tubular element having a first transverse end section connected to said cam disk-element and having radius substantially equal to said third radius and a second transverse end section connected to said needles and having radius substantially equal to said second radius.

3. Head according claim 2, wherein said first and said second end sections of said tubular element are connected by a central portion having maximum radial dimension equal to the difference between said third radius and said second radius.

4. Head according claim 3, wherein said tubular element is constituted by a plurality of substantially longitudinal rods peripherally and circularly distributed around said central conduit, each of said rods having first longitudinal end lengths connected with said needles and distributed on said second peripheral surface and second longitudinal end lengths connected with said discoidal element and distributed on a third peripheral surface tubular and coaxial with said second surface and having said third radius, said first and second end lengths being connected by at least one corresponding radial length not greater than the difference by said third radius and said second radius.

5. Knitting machine for manufacturing flexible hose of the type having a knitted reinforcement layer overlapping a bearing tubular layer, comprising:

a knitting head according to claim 1 and having a guide body with a tubular conduit defining a longitudinal axis for the passage of the bearing layer and having at least one discoidal cam element rotatable about said axis with a first rotation speed;

at least one reel holder rotatable about said longitudinal axis with a second rotation speed and designed for supporting a plurality of reels of yarns designed to form the reinforcement layer;

at least one yarns distributor rotatable unitarily with said reel holder to deviate a portion of yarn form each of said reels toward a corresponding needle.

6. Knitting machine according to claim 5, further comprising a pair of said reel holders reciprocally coaxial to respective distributors, said holders being rotatable about said longitudinal axis with respective equal and opposite second rotation speeds.

7. Knitting machine as claimed in claim 6, wherein said knitting head comprises at least one pair of discoidal elements coaxial with and rotatable about said longitudinal axis with a same first speed having a predetermined value, each of said discoidal elements being operatively connected with respective series of needles to promote their respective oscillation with a predetermined phase difference.

8. Knitting machine as claimed in claim 7, wherein said first speed is equal or lower than said second speed.

9. Knitting machine as claimed in claim 7, wherein said first speed is equal to an integer or fractionated multiple of said second speed.

10. Knitting machine according to claim 6, wherein said distributors are configured to synchronously rotate with the respective yarn series and comprise respective cylindrical collars facing said outlet end portion of said central conduit, coaxial thereto and having a plurality of outlet holes on their peripheral surface for said yarns passing through and deviating them toward corresponding needles along respective frustoconical surfaces having axis coincident with said longitudinal axis and higher base close to said collars.

11. Knitting machine according to claim 10, wherein said frustoconical surfaces have opening angles different of an angular value between 2° and 30°.

12. Knitting machine according to claim 10, wherein said holes have a diameter between 1 mm and 3 mm, their axial distance from the outlet edge of said conduit being preferably between 8 mm and 20 mm.

13. Knitting machine according to claim 10, wherein said cylindrical collars have an inner diameter greater than the diameter of said central conduit of a value between 10 mm and 30 mm.

* * * * *